US005245316A

United States Patent [19]

Conner

[11] Patent Number: 5,245,316

[45] Date of Patent: Sep. 14, 1993

[54] IDENTIFICATION MARKING SYSTEM FOR OBJECTS

[76] Inventor: Charles C. Conner, 23732 Hillhurst Dr., Laguna Niguel, Calif. 92677

[21] Appl. No.: 610,707

[22] Filed: Nov. 8, 1990

[51] Int. Cl.[5] ..... G08B 21/00

[52] U.S. Cl. ..... 340/568; 331/65; 340/572

[58] Field of Search ..... 340/572, 568; 331/65

[56] References Cited

U.S. PATENT DOCUMENTS 5,083,113 1/1992 Slawinski et al. ..... 340/572

*Primary Examiner*—Glen R. Swann, III

*Attorney, Agent, or Firm*—Charles C. Logan, II

[57] ABSTRACT

An identification marking system for objects involves giving each object its own electronic name tag. The electronic name tag can be specific amount of ferrite material that has been added to the object. An electronic reader system then measures the effect said object has on an identifying circuit as the object passes in close proximity to the identifying circuit. The measured effect is then compared to a pre-established value. The value on the electronic reader system becomes the electronic name tag for this specific object. It is not necessary to add ferrite to the objects to be identified. Most materials have a measurable effect on a variety of electronic circuits. An electronic name tag may well be established by simply placing an object in the vicinity of a particular circuit and measuring the results. The results are then compared to a pre-determined set of values. The results of this comparison will provide an electronic name tag for this specific object.

14 Claims, 7 Drawing Sheets

IDENTIFICATION MARKING SYSTEM FOR OBJECTS

BACKGROUND OF THE INVENTION

The invention relates to an identification marking system for objects and more specifically to a system which involves giving each object its own electronic number or name tag.

Presently the most widespread identification marking system in use is that of the bar code system. It is primarily used to provide a means to read a code symbol on an object and input the information contained in the code to a computer system for processing.

There are certain inherent drawbacks when using the bar code resulting in a system that is not entirely satisfactory. One of the principal problems is the fact that the bar code needs to be on the outside surface of the object in order to be properly read.

Another problem relates to the fact that a part of the bar code can be damaged by abrasive action presenting erroneous information to the processing system. Another problem relates to the fact that the mounting surface where the bar code is mounted must be flat, thereby limiting its application in some areas.

In the packaging industry, there is presently no acceptable identification marking system for objects that eliminates the need to physically present the object, properly oriented, to a reader for the system to perform correctly.

As a result, this factor slows the speed of a packaging operation and locks in all of the inherent adverse conditions and functions thereof.

It is an object of the invention to provide a novel identification marking system for objects that allows each object to be given its own electronic name tag or number.

It is another object of the invention to provide a novel identification marking system for objects whose outer configuration would be a problem with the existing bar code system.

It is another object of the invention to provide a novel identification system that eliminates the need for object orientation.

It is another object of the invention to provide a novel identification marking system for objects that would allow for increased speeds for processing objects through manufacturing and packaging operations.

SUMMARY OF THE INVENTION

Applicant's novel identification marking system for objects involves giving each object its own electronic name tag or number.

The name tag can be a specific amount of and a specific mixture of ferrous and/or nonferrous material that has been added to or placed on or in the object. The object with its electronic name tag is passed in close proximity to or through a coil which is the frequency controlling element of an oscillator and provides a frequency change as the object passes thereby. The change in frequency of the oscillator is measured and compared to previous information thereby providing identification of the object.

It is obvious that most materials have a frequency shifting effect on an electronic circuit when placed in close proximity to certain components within most circuits. This proximity effect is predominant when the object is placed in close proximity to the frequency controlling elements. This frequency shift is primarily dependent on the composition and size of the object. Therefore many objects may not require the addition of specific materials to establish an electronic tag or number for identification purposes. It is also obvious that various combinations of materials and various circuit arrangements will provide similar results.

In the circuit shown, an oscillator is so designed that the coil is the predominant component for frequency control.

A real problem exists when an oscillator is fabricated in the required manner for measuring the identification frequency.

It has inherent drift and will not provide the stability and the repeatability this type of system requires for acceptable operation.

To alleviate this inacuracy a precision oscillator is used as a fixed reference which provides the degree of accuracy the identification system requires.

A reference gate generator locked to a reference oscillator is opened for a predetermined time and samples the identification oscillator frequency just prior to object A passing or entering the identification coil. This frequency sample is counted by a reference counter compared to a present number from which the reference oscillator error is determined. This difference number represents the oscillator error and is used to preset the identification counter.

The identification gate generator is activated when object A is in the center of the identification coil and shifts the frequency of the identification oscillator by an amount peculiar to object A. This signal is converted to a pulse train and sent to the identification counter. The identification counter contains the error number, the number now present in the identification counter is the identification number of object A.

The size and shape of the coil can vary to meet the specific size of the object that is to be identified. For instance, it might be circular, oval, triangular or square.

The scenario for one use of the novel identification marking system for objects would be in fully automated grocery market or other retail sales.

There each identical object would have the same electronic name tag containing information pertinent to that particular object. At the checkout point the object would be moved by a conveyor that would pass the object in close proximity to or through the identification coil. The object would be identified and the number or electronic name tag pertaining to that particular object would be presented to a computer for processing. The processed information would provide the basis for pricing, inventory, purchasing and other pertinent data.

Another scenario would involve packaging a variety of materials, such as liquids, solids or pastes.

The present systems used in the packaging industry are poor at best in maintaining correct volume or weight when filling various materials in their respective packages and becomes worse at increasing speeds. It is obvious that using the electronic name tag system named herein, precision volume and/or weight will be maintained at extremely high packaging speeds and with a high degree of accuracy.

DESCRIPTION OF THE PREFERRED EMBODIMENT

Applicant's novel identification marking system for objects will now be described by referring to FIGS. 1 through 4 of the drawings.

Figure 1:
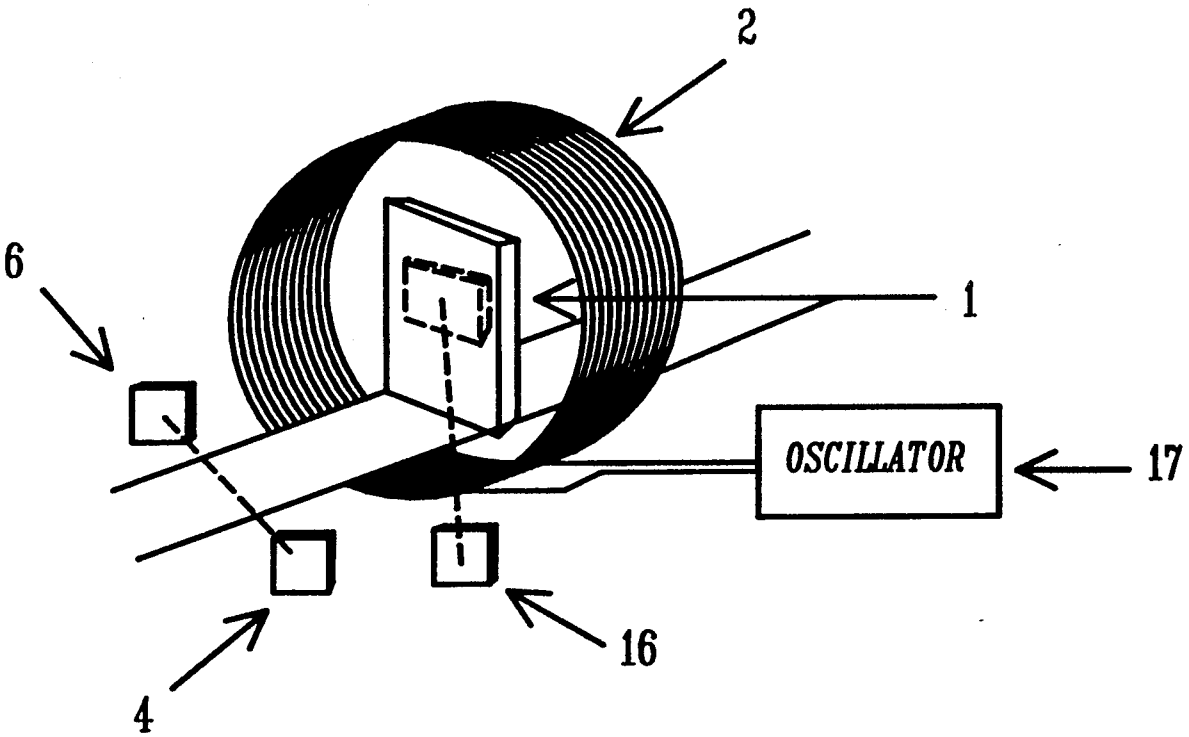
FIG. 1 is a perspective view of an oscillator coil having an object with an electronic name tag passing therethrough on a conveyor.
Figure 2:
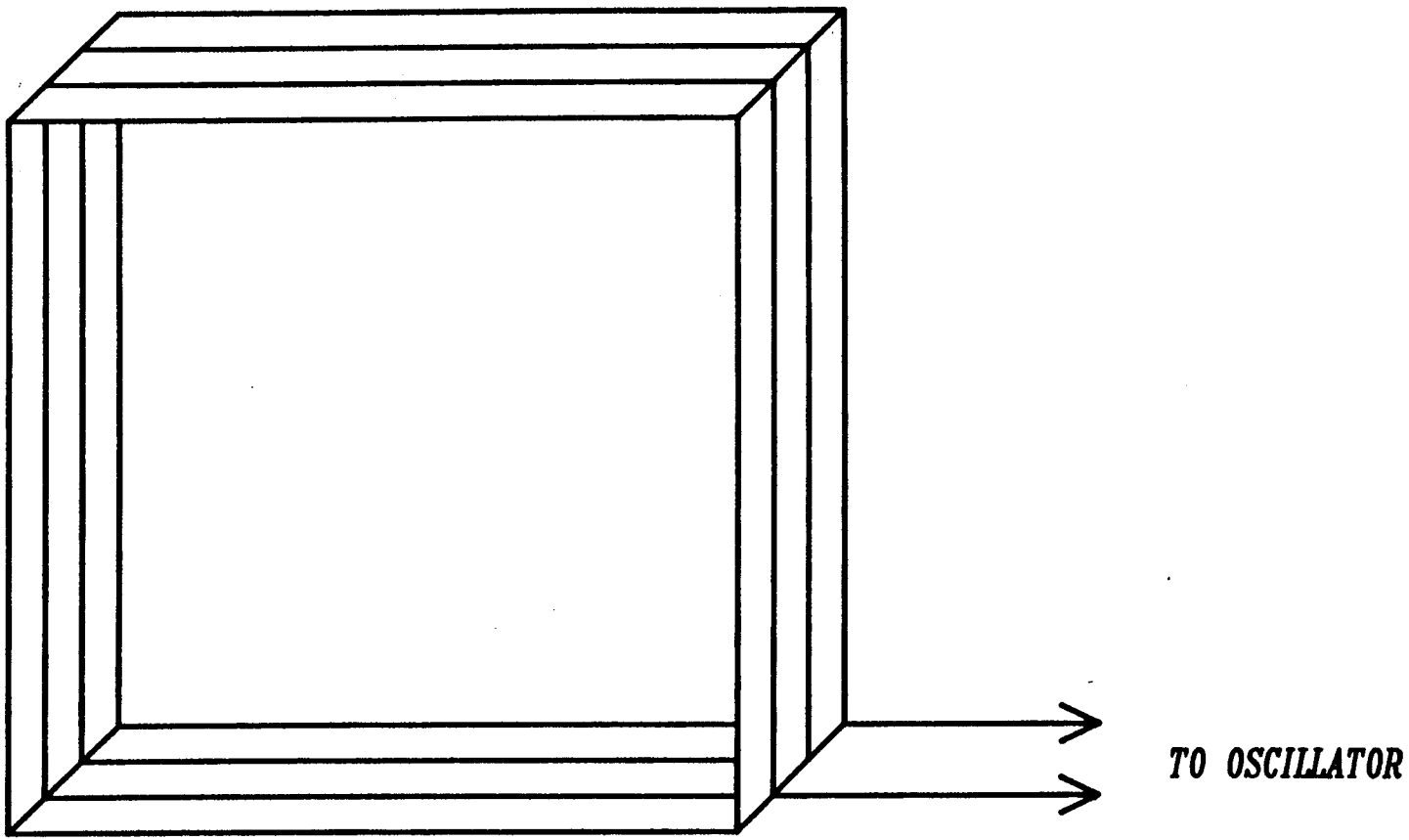
FIG. 2 illustrates an oscillator coil that has a square configuration.

In FIG. 1 an object 1, having an electronic name tag integral therewith, is passed along a conveyor 4 through the oscillator coil 2 of the oscillator 17. In FIG. 2, oscillator coil 3 is illustrated having a square configuration.

Figure 3:
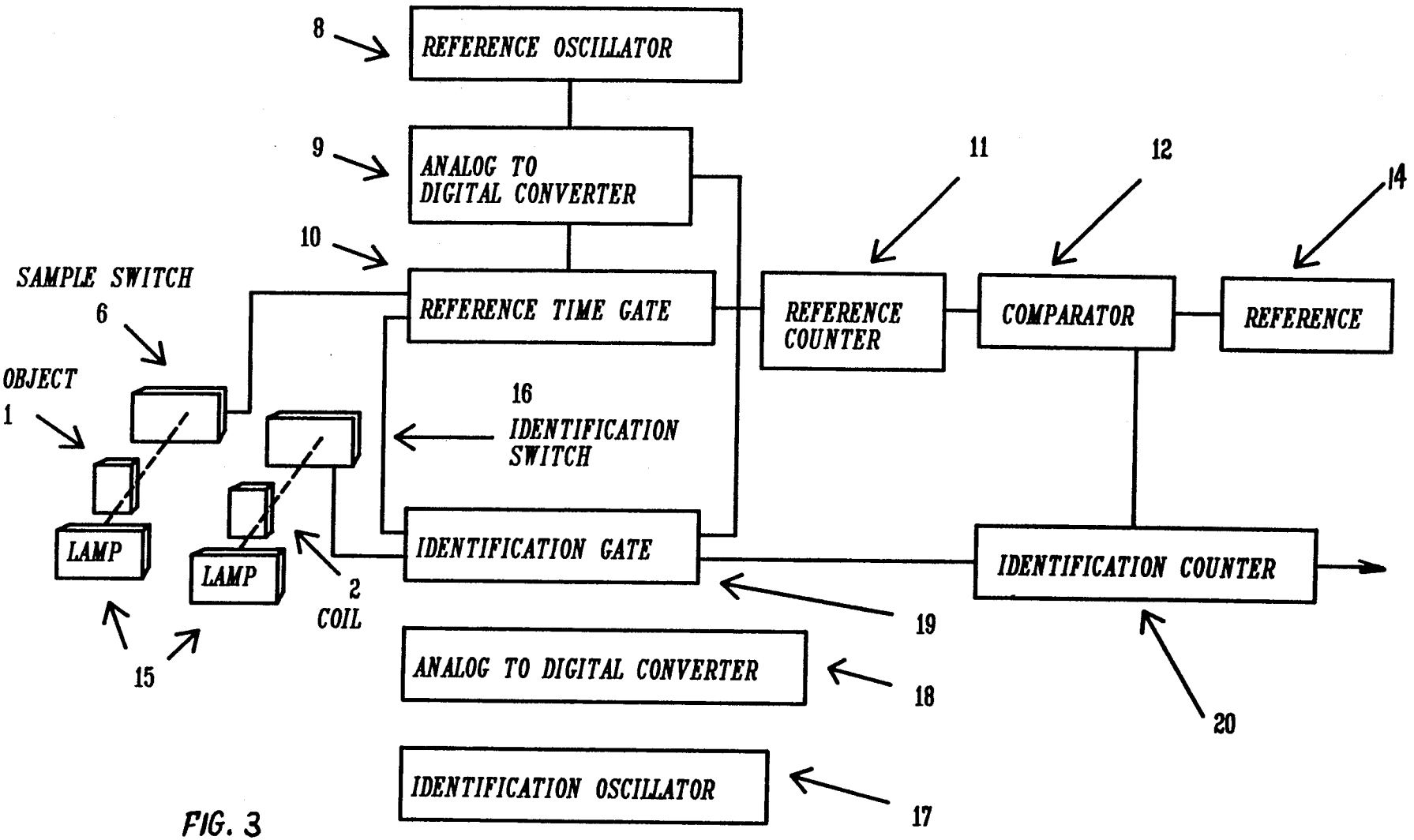
FIG. 3 is a block diagram of the identification marking system.
Figure 4A:
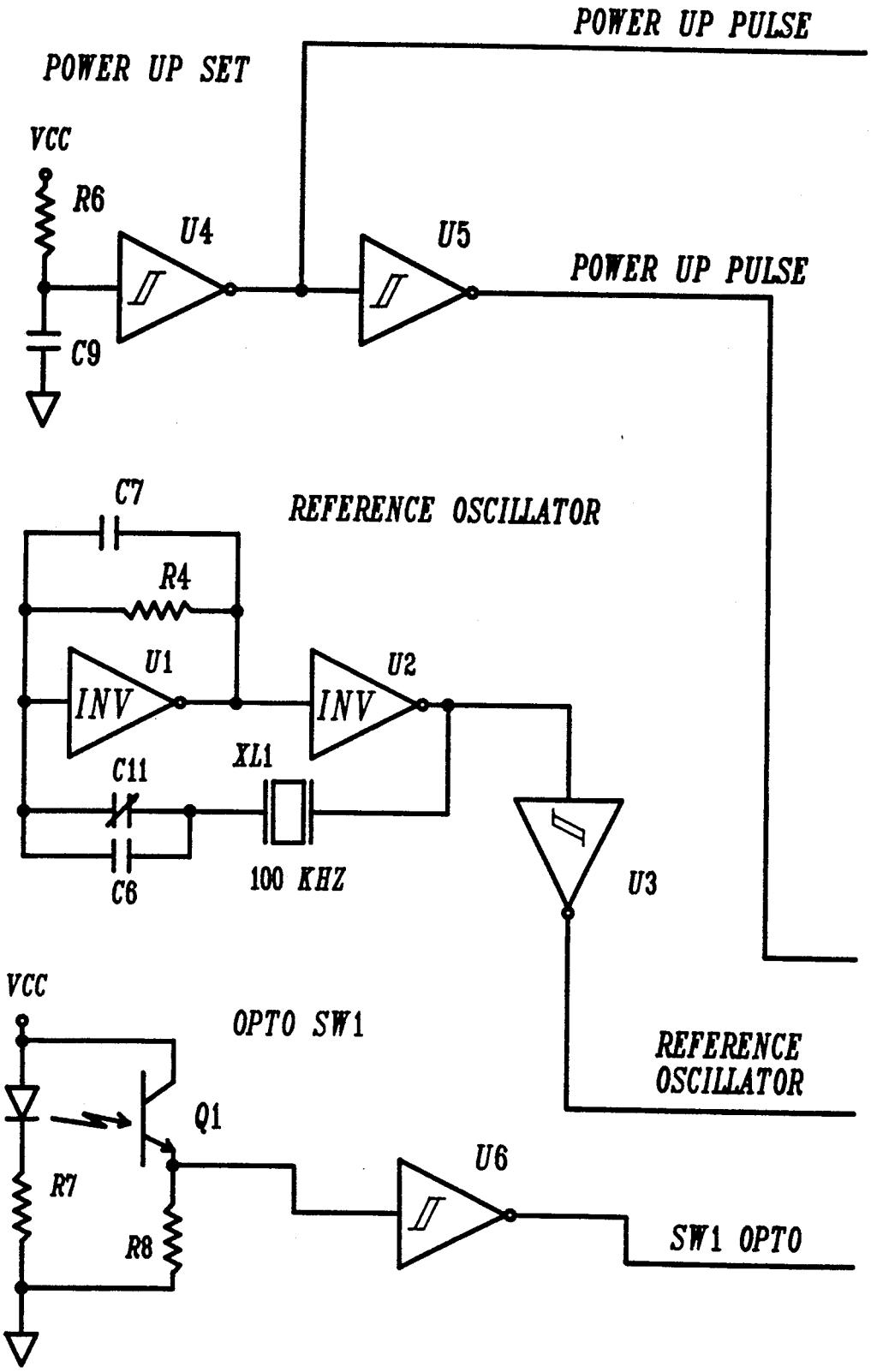
FIG. 4 illustrates the oscillator circuit of the control circuit of the identification marking system.
Figure 4B:
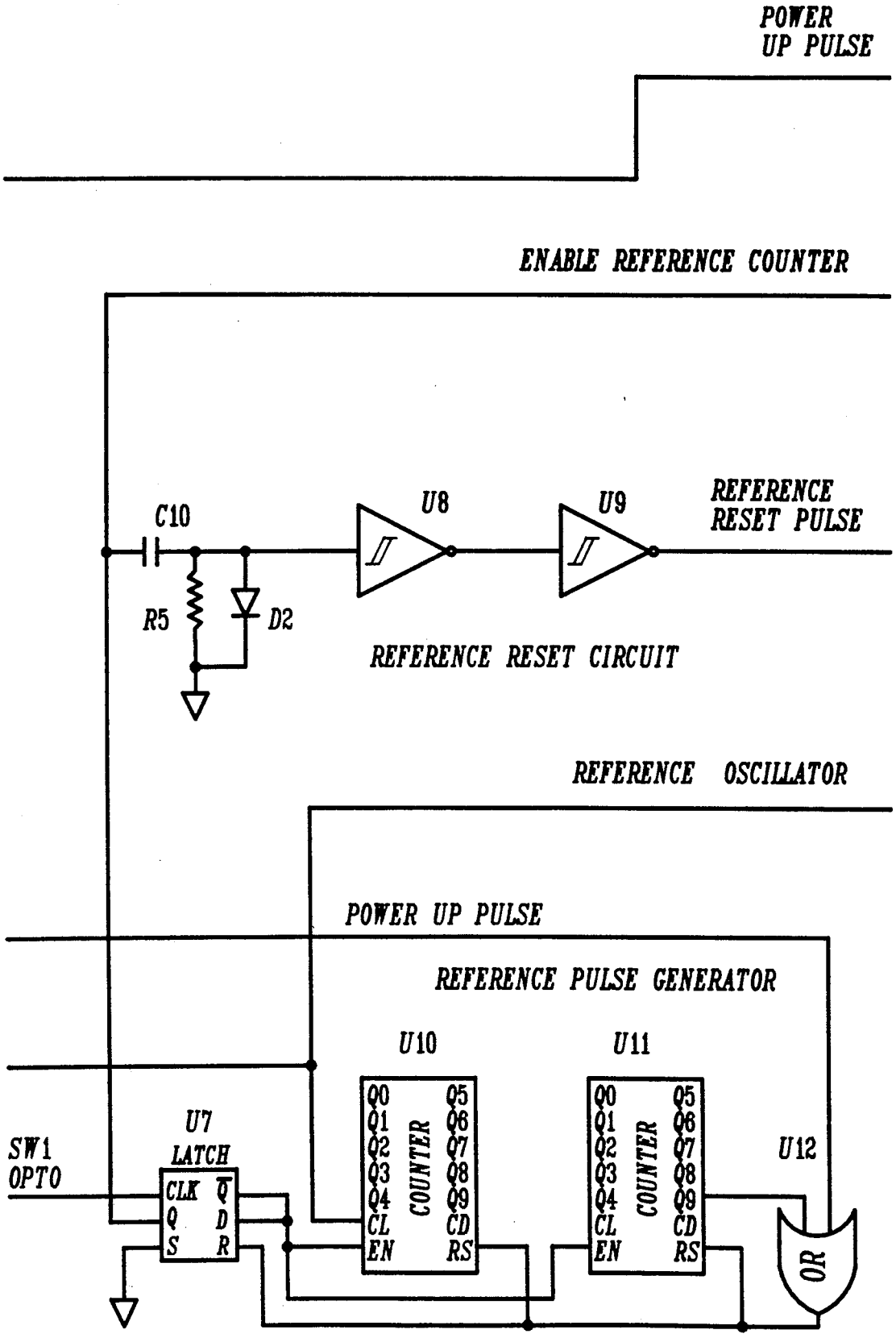
Figure 4C:
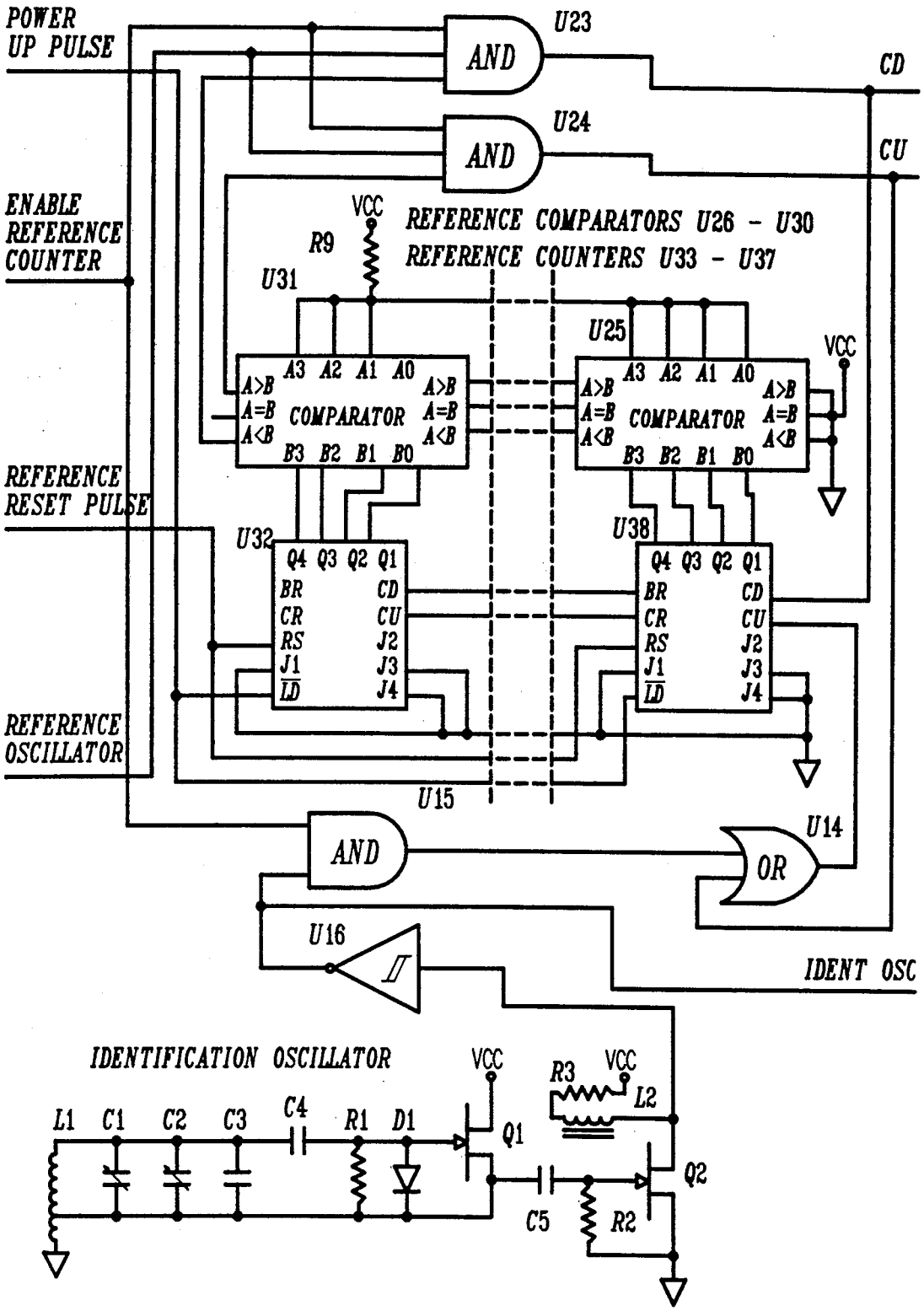
Figure 4D:
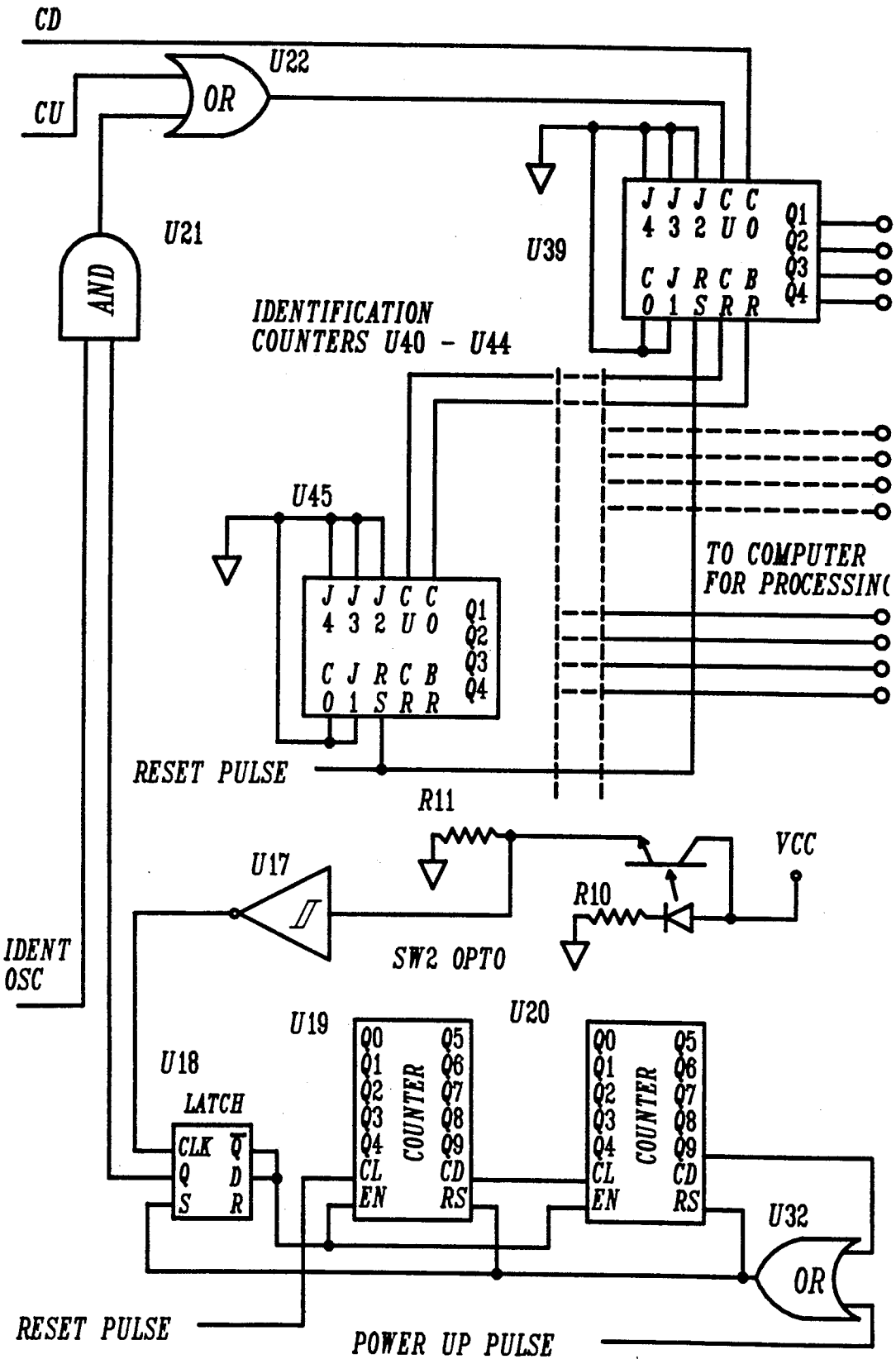

The block diagram of FIG. 3 shows that the process of identifying object 1 starts with it passing through opto sample switch 6. Switch 6 operates the reference gate generator 10, the open time of which is predetermined by reference oscillator 8 and the reference gate generator counters.

Reference oscillator 8 is a precision oscillator from which all timing functions are derived.

Reference gate generator 10 presents a group of pulses from the identification oscillator 17, via analog-to-digital converter 18 to the reference counter 11.

Reference counter 11 has beeen preset to zero; therefore, the number of pulses received by the reference counter 11 reflects the frequency of the identification oscillator at this instance in time. The number of pulses counted by reference counter 11 is presented to comparator 12 and compared with a number preset in fixed reference 14 and presented to comparator 12. The difference between the number in the reference counter 11 and fixed number at reference 14 is the error of the identification oscillator at this instance in time. This error number is presented to identification counter 20. This number can be either subtractive or additive.

Object 1 then moves into identification oscillator coil 2 and operates the identification opto switch 16 when object 1 is located in the center of oscillator coil 2. Identification switch 16 activates the identification gate generator 19 which generates a gate pulse of exactly the same time period as the reference gate generator. This allows a number of pulses to be sent to identification counter 20. The number of pulses sent to identification counter 20 is representative of object 1, now present in coil 2. The identification counter 20 now contains the number that identifies object 1. This number is presented to a computer for processing.

The electronic circuitry for the identification tagging system is illustrated in FIG. 4.

The power up circuit operates as follows:

In FIG. 4 when power is applied, C9 charges through R6 to a value approximately equal to VCC. The junction of C9 and R6, connected to the input of schmitt trigger inverter U4 maintains the output of U4 high for a time period determined by R6 and C9 with respect to the threshold of U4. This 0 pulse is applied to the LOAD (LD) inputs of the reference counters U32 through U38.

They are now preset to the same number at the A inputs of the comparators U25 through U31. The preset number for U32 through U38 is determined by the digital number set at the J inputs of counters U32 through U38. A reset pulse of the same time duration is provided to the reference counters U39 through U45 via U5 and U13.

The reference oscillator operates as follows:

In FIG. 4 integrated circuit U1 is an inverter therefore the output is shifted 180 degrees from the input. Resistor R4 and capacitor C7 provides a small amount of feed-back delayed in time. This time delay starts and maintains the oscillation of U1 at a frequency dependent on the delay time established by C7 and R4. U1 drives U2 with the output of U2 coupled to the input of U1 through crystal XL1 and parallel capacitors C11 and C8 providing an in-phase feed-back. By the appropriate adjustment of C11, feed-back will lock the oscillator at the frequency of crystal XL1. The long term stability is determined by the quality of crystal XL1 and the manner in which it is physically installed in the system. The reference oscillator circuit uses a 100 KHZ crystal, therefore the frequency of oscillation is 100 KHZ.

The frequency of oscillation established by R4 and C7 must be close to the crystal frequency to maintain consistent operation.

The oscillator output drives schmitt trigger U3 providing a square wave output. The reference oscillator runs at all times when power is applied.

The reference reset circuit operates as follows:

The postive edge of the gate pulse at Q output of U7 drives the input of schmitt trigger U8 high via C10. This provides a reset pulse to the reference and identification counters, via U9 and/or U13. The duration in time is established by the time constant of C10 and R5 with respect to the threshold of U9. Diode D2 prevents negative signals greater than 0.6 of a volt to appear at the input of U8 when C10 discharges preventing accidental damage to U8. The time duration of the reset pulse is extremely short with respect to the reference oscillator frequency thereby causing a reference counter error of not more than $+-1$.

The reference opto switch SW1 operates as follows:

In the static condition the photo sensitive transistor receives a beam of light from the accompanying light emitting diode. As a result of the received light from the light emitting diode the photo sensitive transistor develops a voltage across R6 approximately equal to VCC.

This voltage is applied to the input of schmitt trigger U6, an inverter forcing the output to approximately 0.

When object 1 interrupts the light beam the voltage across R6 drops to 0, forcing U6 to change state and provide fast rising, positive going signal to the clock, (CLK), input of U7. Resistor R7 limits the current through the light emitting diode to the required amount for proper operation.

The reference pulse generator operates as follows:

Integrated circuit U7 is a D latch, that when activated by U6 the Q output provides a gate pulse to U15 with a time duration equal to the reference oscillator frequency divided by 100. The BAR Q output of U7 provides a 0 inhibit signal for AND GATES U23 and U24. BAR Q output of U7 also enables counters U10 and U11 which divide the reference oscillator signal by 100. At the count of 100, LATCH U7 is reset by Q9 of U11, Q is set low and BAR Q set high. This action provides a 1 millisecond gate pulse to the AND GATE U15 thereby allowing the output from the identification oscillator, through OR GATE U14, to appear at the count-up (CU) input of the reference counter for a period of 1 millisecond.

The identification oscillator operates as follows:

L1, C1, C2, C3 form a tuned circuit whose resonant frequency is determined principally by the value of the respective reactance of L and C. The gate of Q1 is connected to the tuned circuit via C4. The source of Q1 is connected above ground on L1 to provide sufficient feedback creating an oscillator whose frequency is determined by the tuned circuit comprised of L1, C1, C2, C3. R1 is a conventional bias resistor maintaining an appropriate bias for Q1. D1 clamps the gate of Q1 at six tenths of a volt, preventing excessive positive voltage to appear on the gate of Q1. C5 couples the output of transistor Q1 to the input of transistor Q2. Q2 is a field effect transistor functioning as a linear amplifier whose purpose is to increase the amplitude of the signal to the required level for the analog-to-digital converter, the schmitt trigger U16.

It is obvious that other oscillator configurations will serve the same purpose, providing the oscillator components are of the appropriate configuration.

The identification opto switch SW2 operates as follows:

In the static condition the photo sensitive transistor SW2 receives a beam of light from the accompanying light emitting diode.

As a result of the received light from the light emitting diode the photo sensitive transistor develops a voltage across R11 approximately equal to VCC.

This voltage is applied to the input of the schmitt trigger U17, an inverter, forcing the output to approximately 0. When object 1 interrupts the light beam the voltage across R11 drops to 0, forcing U17 to change state and provide a fast rising, positive going signal to the clock, (CLK), input of U18. Resistor R10 limits the current through the light emitting diode to the required amount for proper operation.

The identification gate pulse generator operates as follows:

Integrated circuit U18 is a D latch, that when activated by U17 the Q output provides a pulse to the AND GATE U21. BAR Q output of U18 enables counters U19 and 20 which divide the reference oscillator signal by 100. At the count of 100 LATCH U18 is reset by Q9 of U20, Q is set low and BAR Q set high. This action provides a 1 millisecond gate pulse to the AND GATE U21 thereby allowing the output from the identification oscillator, through OR GATE U22, to appear at the count-up (CU) input of the identification counter for a period of 1 millisecond.

The reference counter and comparator operates as follows:

The Q output of latch U7 enables AND GATE U15 for a period of 1 millisecond thereby presenting the output of the identification oscillator Q1 to the count-up (CU) input of the identification counter via Q2, U16, U15 and U14. The Q outputs of the identification counter are presented to the B input of the four-bit magnitude comparators U25 through U31. The A inputs of the comparators are clamped with a fixed number which is close to the identification oscillator frequency for a time segment of 1 millisecond. When the number from the reference counter at the B inputs of the comparators is larger than the reference number at the A input, output A<B is approximately VCC and A>B is O. ANDGATE U23 is enabled and the output of the reference oscillator is presented to reference counters U25 through U38 and the identification counters U39 through U45 at the count down (CD) inputs. This will force the reference counters U32 through U38 to count down until the B input is equal to the A input of comparators U25 through U31 which will force the output A<B to returned to 0. A>B will equal 0 and A=B will equal VCC.

The same number of pulses are also applied to the count down (CD) input of identification counter U39 through U45 via OR GATE U22. The identification counters U39 through U45 now contain an error number equal to the error of the identification oscillator frequency aat this instance in time.

It can be seen that the process is the same for A>B except that AND GATE U24 is enabled and the error number in the identification counter will be a positive number.

The identification counter operates as follows:

By the action of the reference counter and the comparators the identification counter contains the error, or difference, between the reference oscillator and the identification oscillator at this period in time and may be added to or subtracted from the reset, 0 condition of the identification counters. A few seconds after object 1 passes opto switch SW1, object A activates opto switch SW2 when object A is in the approximate center of coil L1 of the identification oscillator, AND GATE U21 is enabled by Q of U18 and the identification counter counts the pulses from the identification oscillator Q1 for 1 millisecond of time. The number now contained in the identification counter is the identification for object 1.

What is claimed is:

1. An object identification system comprising:

an oscillator which will change its frequency of oscillation when an object is placed in proximity of the elements that control the frequency of said oscillator;

means for measuring the frequency change of said oscillator when an object passes through or near the oscillator frequency controlling elements;

means for determining said oscillator's instability/drift;

means for correcting said oscillator's instability/drift;

means for displaying said frequency change of said oscillator; and means for storing the frequency change of said oscillator for future use.

2. An object identification system as recited in claim 1 wherein said means for measuring the frequency change of said oscillator comprises a reference standard for determining the magnitude of frequency change.

3. An object identification system as recited in claim 1 wherein said means for determining and correcting said oscillator's instability/drift comprises a reference timing gate for providing a timing reference.

4. An object identification system as recited in claim 1 wherein said means for determining and correcting said oscillator's instability/drift comprises a reference frequency counter for counting and storing a reference frequency.

5. An object identification system as recited in claim 1 wherein said means for determining said oscillator's instability/drift comprises a multibit digital magnitude comparator.

6. An object identification system as recited in claim 1 wherein said means for measuring the frequency change of said oscillator comprises an analog-to-digital converter for converting said oscillator's signal to a digital format.

7. An object identification system as recited in claim 1 wherein said means for measuring the frequency change of said oscillator comprises an identification frequency counter for counting the frequency of said oscillator.

8. An object identification system for objects comprising;

an oscillator which will undergo a change of frequency when an object containing a predetermined mixture of ferrous and non ferrous materials passes through or near the frequency controlling elements of said oscillator;

means for measuring the frequency change of said oscillator when an object passes through or near the oscillator frequency controlling elements;

means for determining said oscillator's instability/-drift;

means for correcting said oscillator's instability/drift;

means for displaying said frequency change of said oscillator; and means for storing the frequency change of said oscillator for future use.

9. An object identification system as recited in claim 8 wherein said means for measuring the frequency change of said oscillator comprises a frequency standard for determining the magnitude of frequency change.

10. An object identification system as recited in claim 8 wherein said means for determining and correcting said oscillator's instability/drift comprises a reference timing gate for providing a timing reference.

11. An object identification system as recited in claim 8 within said means for determining and correcting said oscillator's instability/drift comprises a reference frequency counter for counting and storing a reference frequency.

12. An object identification system as recited in claim 8 wherein said means for determining said oscillator's instability/drift comprises a multibit digital magnitude comparator.

13. An object identification system as recited in claim 8 wherein said means for measuring the frequency change of said oscillator comprises an analog-to-digital converter for converting said oscillator's signal to a digital format.

14. An object identification system as recited in claim 8 wherein said means for measuring the frequency change of said oscillator comprises an identification frequency counter for counting the frequency of said oscillator.

* * * * *